United States Patent [19]

Shaffer et al.

[11] Patent Number: 4,674,749

[45] Date of Patent: Jun. 23, 1987

[54] MAZE PUZZLE

[75] Inventors: Ralph Shaffer, Columbia Station; Susan Trentel, Lakewood, both of Ohio

[73] Assignee: Those Characters From Cleveland, Inc., Independence, Ohio

[21] Appl. No.: 819,736

[22] Filed: Jan. 21, 1986

[51] Int. Cl.[4] ..... A63F 9/06

[52] U.S. Cl. ..... 273/153 R

[58] Field of Search ..... 273/153 R, 159; 2/235, 2/236, 237

[56] References Cited

U.S. PATENT DOCUMENTS

| | | | |
|---|---|---|---|
| 839,733 | 12/1906 | Davenport | 273/153 R X |
| 1,154,136 | 9/1915 | Simao | 273/153 R |
| 1,628,891 | 5/1927 | Lefkowitz | 2/235 |
| 2,525,738 | 10/1950 | Tormey | 273/126 A |
| 2,563,608 | 8/1951 | Laufer | 273/109 |
| 2,714,511 | 8/1955 | Derrig et al. | 273/153 R |
| 2,998,973 | 9/1961 | Schaper | 273/1 GD |
| 3,069,805 | 12/1962 | Burrows | 273/153 R UX |
| 3,406,971 | 10/1968 | Koff | 273/109 |
| 3,625,516 | 12/1971 | Handweller | 273/153 R |
| 3,731,933 | 5/1973 | Grant | 273/153 R X |
| 3,843,134 | 10/1974 | Vallejo | 273/159 X |
| 3,989,255 | 11/1976 | Raffa | 273/153 R |
| 4,465,280 | 8/1984 | Dimitrio | 273/153 R |

*Primary Examiner*—Anton O. Oechsle

*Attorney, Agent, or Firm*—Renner, Otto, Boisselle & Lyon

[57] ABSTRACT

A maze puzzle, characterized by a quality of flexibility, pliancy or suppleness, includes a maze or labyrinth consisting of a network of passages having flexible walls that are manipulable by the player to effect movement therethrough of a solving piece such as a ball. The walls of the maze puzzle preferably are of flexible, double layered fabric with the outer or cover layer serving to conceal the inner or liner layer which may be closed upon itself to form hidden obstructions at selected locations in the maze which prevent passage of the solving piece. In this manner, concealed dead-end passages are provided whereby the player must rely on his sense of feel to solve the puzzle. The cover layer preferably is of a soft and supple cloth fabric that is pleasing in appearance and feel.

20 Claims, 5 Drawing Figures

MAZE PUZZLE

DISCLOSURE

The invention herein disclosed relates generally to amusement devices and, more particularly, to a maze puzzle having a quality of flexibility, pliancy or suppleness heretofore not found in the art.

BACKGROUND

Maze puzzles typically include a maze or labyrinth of passages through which a solving piece, such as a ball, is moved by a player to solve the puzzle. In some maze puzzles the maze and solving piece can be seen by the player through transparent or translucent walls to facilitate his or her solving of the puzzle. In other maze puzzles, the maze, maze elements and/or solving piece may be concealed to add an additional degree of difficulty to the puzzle. Examples of the former type of puzzles can be found in U.S. Pat. Nos. 2,525,738, 2,563,608 and 3,406,971, and examples of the latter type of puzzles can be found in U.S. Pat. Nos. 839,733, 1,154,136, 2,714,511, 2,998,973, 3,625,516 and 4,465,280.

The maze puzzles described in the above noted patents generally are of a rigid construction, i.e., the puzzle housing, passage walls, etc., are made of relatively rigid material. One result of this is that advancement of the solving piece through the maze passages usually is effected indirectly as by tilting, rotating, turning or otherwise controlling the orientation of the puzzle with movement of the solving piece being primarily effected by gravity. Reliance also has been had on magnetic or mechanical control members to advance the solving piece through the maze passages that may be in the form of slots, channels, etc. For example, U.S. Pat. No. 3,625,516 shows a maze puzzle wherein a feeler rod is used to guide a stud thereon through a maze of slots in a container. Because the slots are hidden from view, the player must rely on his sense of touch in order to solve the puzzle.

SUMMARY OF THE INVENTION

Unlike prior maze puzzles, a maze puzzle according to the subject invention is characterized by a quality of flexibility, pliancy or suppleness which gives rise to new elements of interest and manual dexterity and which also may give rise to a relaxing or soothing effect. The maze puzzle includes a maze or labyrinth consisting of a number of passages having flexible walls that are manipulated or plied by the player to effect movement therethrough of a solving piece such as a ball. Manipulation of the passage walls is akin to a squeezing action which enables feeling and direct pushing of the solving piece through a passage.

As is preferred, the walls of the passages are opaque to hide obstructions which prevent passage of the solving piece at respective selected locations in the maze. In this manner, concealed dead-end passages may be provided whereby the player must rely on his sense of feel, i.e., tactile feedback, to solve the puzzle as by moving the solving piece from a start position to an end position via the passages of the maze.

Further in accordance with the invention, the walls of the maze passages preferably are made from flexible, double-layered fabric. An inner or liner layer defines the interior of the passage and such liner layer may be closed upon itself at selected locations in the maze to form respective obstructions in the passages of the maze. The outer or cover layer covers the liner layer and hides from the view of the player the obstructions formed by such closure of the liner layer. Both layers preferably are made of flexible cloth fabric, and the outer layer preferably is a soft and supple cloth fabric that is pleasing in appearance and feel. The obstructions are formed in such a way that they cannot be feelingly sensed by the player whereby their location can only be determined by restriction to movement of the solving piece.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
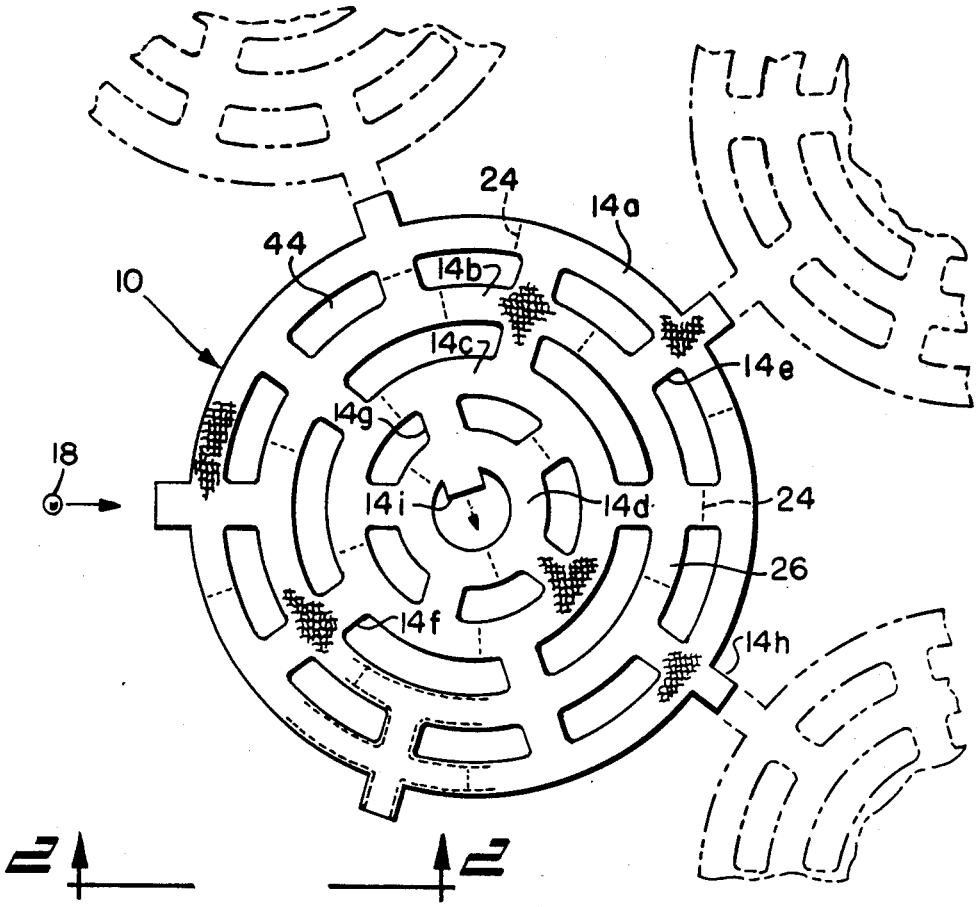
FIG. 1 is a plan view of a maze puzzle according to the subject invention.

Referring now in detail to the drawings and initially to FIG. 1, a maze puzzle according to the subject invention is indicated generally at 10. The puzzle 10 includes a maze or labyrinth 12 consisting of a network of passages 14 having flexible or pliant walls. As is preferred, the walls of the passages 14 are so flexible or pliant that such walls and, consequently, the maze 12 are not self-supporting. In FIG. 1, the maze is shown as such would appear in plan view when supported flatly on a planar surface and the following description will assume such generally planar disposition of the maze. However, in use or storage, the maze may be folded, bent, rolled, wrinkled, crumpled, etc., by reason of its preferred high degree of flexibility or pliancy.

In the illustrated preferred embodiment and best mode of the invention, the maze 12 includes four concentric circular passages 14*a–d* and radial connecting passages 14*e–g* between the relatively adjacent but radially spaced circular passages. The connecting passages 14*f* between the two intermediate circular passages 14*b* and 14*c* are radially aligned with every other connecting passage 14*e* between the two outermost circular passages 14*a* and 14*b*, and the connecting passages 14*g* between the two innermost circular passages 14*c* and 14*d* are circumferentially staggered with respect to the connecting passages 14*f*. The maze also includes five entry passages 14*h* extending radially outwardly from the outer circular passage 14*a* and one exit passage 14*i* extending radially inwardly from the inner circular passage 14*d*. The maze preferably is symmetrical as along a diameter and also its center plane so that at least some of the passages cannot be positionally distinguished from their symmetrical counterparts in relation to the overall network of passages.

The puzzle 10 may be solved by moving a solving piece, such as a ball 18, through the maze passages 14 from an entry passage 14*h* to the exit passage 14*i*, or vice versa, as desired. The passages and ball are relatively sized to allow for forced sliding movement of the ball through the passages. The ball may be advanced along a passage by squeezing the passage just to the rear of the ball's center so as to push the ball forwardly. Such manipulating of the passage may be repeated at progressively advanced positions of the ball to effect progressive movement of the ball through the maze.

As is preferred, obstructions are provided in the passages 14 to restrict passage of the solving piece at respective selected locations in the maze 12. In FIG. 1, exemplary locations of the obstructions are indicated by the broken lines 24. Preferably, the walls of the passages are opaque to hide the obstructions 24 from the view of the player. In this manner, concealed dead-end passages may be provided, such as segment 26 of the circular passage 14*b*, whereby the player must rely on his sense of feel, i.e., tactile feedback, to solve the puzzle. As is preferred, the obstructions are provided in such a manner that they cannot be feelingly sensed by the player. Accordingly, the player will only be able to determine the location of an obstruction when movement of the solving piece along a passage is prevented by such obstruction.

The walls of the passages 14 preferably are of flexible, double layered fabric. As seen in FIGS. 2–5, there is provided an inner or liner layer 30 which forms the interior of the passage. The liner layer 30 may be closed upon itself, as by securing together opposite sides of the liner layer, to form obstructions 24 in the passages at selected respective locations in the maze. An obstruction may be formed, for example, by sewing together two sheets 30*a*, 30*b* of liner material along a seam line 32 transverse to the axial extent of a passage. Of course, other techniques may be used to form the obstructions such as by heat sealing the two sheets 30*a*, 30*b* together along such transverse seam line 32 provided that the liner sheets are made of suitable heat sealable material. The liner layer preferably has a smooth interior surface to facilitate sliding of the ball along the passage. Generally, the liner layer should be formed from flexible lightweight material that does not fray to help stabilize narrow seam allowances.

The outer or cover layer 34 of a passage wall 14 covers the liner layer 30 and hides from the view of the player the obstructions 24 formed only in the liner layer as above discussed. The cover layer 34 preferably is made of a flexible cloth fabric and most preferably is a soft and supple cloth fabric that is pleasing in appearance and feel. As is preferred, the cover layer is formed of suitable material, such as a relatively heavy cloth fabric, and the obstructions so formed such that they cannot be felt through the cover layer. Generally, the cover layer fabric should have sufficient body to help hide the obstructions sewn into the lining fabric, should be resistant to ravelling and fraying even with narrow seam allowances, and should be somewhat stretchable to allow smooth controlled passage of the ball. As is preferred, the cover layer material may be a knitted synthetic velour fabric and the liner material may be a lightweight polyester nonwoven interfacing fabric. Because of the dual layer construction of the passage walls, the cover layer will conceal any evidence of an obstruction formed in the liner layer.

Figure 5:
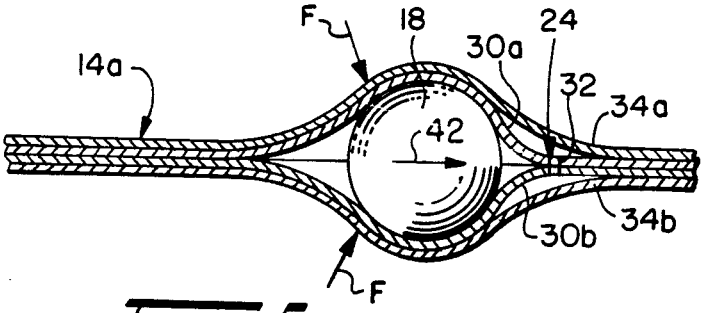
FIG. 5 is an enlarged fragmentary longitudinal section through a passage of the maze puzzle taken substantially along the line 5—5 of FIG. 3 and showing the solving piece in relation to an obstruction in such passage.

In the illustrated preferred embodiment, the maze 12 is formed from two sheets 30*a*, 30*b* of liner material and two sheets 34*a*, 34*b* of cover material, all having the same pattern defining the network of passages 14. The sheets 30*a*, 30*b* of liner material may be laid one atop the other and joined as by sewing, heat sealing, etc., along seam lines 32 extending generally transversely to the axial extent of the passages to form the obstructions 24 at desired respective locations in the maze. After the obstructions have been formed, the thusly joined liner sheets 30*a*, 30*b* may be sandwiched between the layers 34*a*, 34*b* of cover material and then such layers joined together along the edges thereof as by the stitching indicated at 38 to form therebetween the passages 14. As is preferred, the portions of the liner and cover sheets extending between the stitched or otherwise formed seams 38 closing respective sides of the passages are not joined together as best illustrated in FIG. 5. The entry and exit passages 14*h*, 14*i* preferably are open to the outside to permit ingress or egress of the solving piece 18 as illustrated at 40 in FIG. 2.

Figure 2:
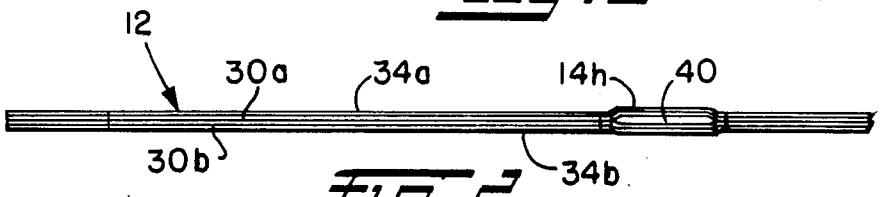
FIG. 2 is an enlarged fragmentary edge view of the maze puzzle looking generally in the direction of the arrows 2—2 of FIG. 1.
Figure 3:
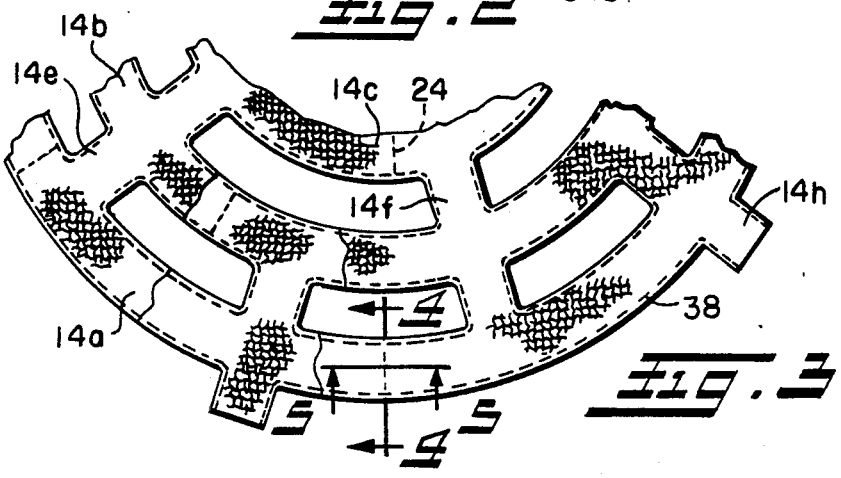
FIG. 3 is an enlarged portion of the plan view of FIG. 1 wherein parts have been broken away for illustration.
Figure 4:
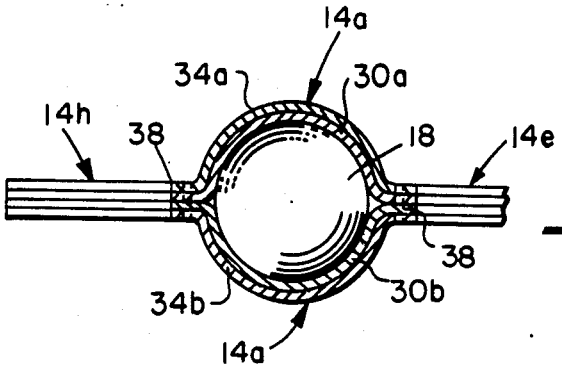
FIG. 4 is an enlarged transverse section through a passage of the maze puzzle taken substantially along the line 4—4 of FIG. 3 and showing a solving piece in relation to the passage.

In FIG. 4, the ball 18 is shown positioned in a passage 14 between the sheets 30*a*, 30*b* of liner material. As shown, the passage 14 can generally assume a circular shape of approximately the same diameter as the ball. However, the sheets of material forming the walls of the passages generally will lie flat one atop the other in the absence of a ball being located therebetween as seen in FIG. 2. Because of this tendency of the walls to collapse upon themselves because of their flexibility, the ball will remain essentially stationary except when being manipulated in the above discussed manner. More particularly, the player's thumb and index finger may be positioned at respective opposite sides of the passage just behind the center of the ball and then squeezed together to force the ball forwardly along the passage.

If desired, the material forming the walls of the passages 14 may be a material that is resiliently stretchable to allow movement of the ball through a passage of a size less than that of the solving piece 18 when the walls are unstretched. This may be done to provide a desired feel to the puzzle. Also, the flexible material of the walls, the size of the passage and the relative size and shape of the solving piece may be otherwise varied to provide change in the characteristics of the puzzle.

In FIG. 4, the ball 18 is shown in close proximity to an obstruction 24 formed by sewing together of the two sheets 30*a*, 30*b* of liner material at the seam line 32. As force is applied to the wall of the passage as indicated by the arrows F such as by the thumb and index finger of the player, movement of the ball along the passage in the direction of arrow 42 will be prevented by the obstruction. Upon encountering an obstruction, the player would then have to move the ball in a different direction in his or her effort to find the solution path.

As will be appreciated, a maze puzzle according to the subject invention may take many different forms in addition to the illustrated preferred embodiment and best mode. To describe the many endless variations would be a task of considerable magnitude. By way of example only, a rectangular network of passages could be provided in place of the illustrated circular network of passages, or connecting passages might serve to connect circular passages other than those which are relatively adjacent. In the latter case, a connecting passage might pass over the intermediate circular passages 14*b*, 14*c* to connect, for example, the inner and outer circular passages 14*a*, 14*d* to create what might be considered a three dimensional network in contrast to the generally two dimensional network shown in FIG. 1. Of course, the maze in use usually will not assume a planar condition but rather will assume a generally irregular three dimensional condition as the puzzle is being solved by a player. It also is noted that the several passages may all be contiguous, i.e., without openings such as those seen at 44 in FIG. 1 being provided in the overall pattern of the maze. For instance, two solid sheets of liner material might be joined together as by stitching to form a network of passages including the obstructions. That is, the two solid sheets of liner material may be joined together to close respective sides of the passages as well as transversely across such passages to form the obstructions. The thusly joined sheets of liner material might then be covered by like size solid outer sheets of cover material stitched only along the outer perimeter of such sheets. In this manner, not only would the obstructions be hidden from view but also the passages. Accordingly, the player would have to rely on his sense of feel not only to bypass obstructions but also to find the interconnecting passages.

As further seen in FIG. 1, provision also may be made for interconnecting plural maze puzzle modules to form a larger network of passages, such other maze puzzle modules being shown in phantom outline. The entry/exit passages 14*h*, 14*i* may be adapted for coupling to a respective entry/exit passage of such other maze puzzle modules such as by the provision of plastic connecting elements (not shown) secured at the entry/exit passages.

The maze puzzle 10 may be used by a single player to play a solitaire game. The puzzle or plural puzzles also may be used as a competitive game by two or more players. For example, two players using respective like puzzles may compete to see who can first solve the puzzle.

Although the invention has been shown and described with respect to a preferred embodiment and a few alterations or modifications thereof, it is obvious that still other equivalent alterations or modifications will occur to others skilled in the art upon the reading and understanding of this specification. The present invention includes all such equivalent alterations and modifications, and is limited only by the scope of the following claims.

We claim:

1. A maze puzzle comprising a maze of passages having flexible walls manipulable by a player to effect movement of a solving piece through said passages, and a plurality of obstructions in said passages for blocking passage of the solving piece through said passages at respective locations in said maze, said obstructions and walls being so formed that the locations of said obstructions cannot be directly identified by exterior viewing or feeling of said walls.

2. A maze puzzle as set forth in claim 1, wherein said flexible walls are of fabric material.

3. A maze puzzle as set forth in claim 2, wherein said fabric material is a cloth fabric.

4. A maze puzzle as set forth in claim 1, wherein the flexible walls of said passages are opaque to hide said obstructions from the view of the player.

5. A maze puzzle comprising a maze of passages having flexible walls manipulable by a player to effect movement of a solving piece through said passages, said flexible walls including an inner layer forming the interior of said passages and an outer layer covering the inner layer.

6. A maze puzzle as set forth in claim 5, further comprising obstruction means in one of said passages for preventing passage of the solving piece through said one passage.

7. A maze puzzle as set forth in claim 6, wherein said inner layer is closed upon itself to form said obstruction means.

8. A maze puzzle as set forth in claim 6, wherein opposite sides of said inner layer are seamed together to form said obstruction means.

9. A maze puzzle as set forth in claim 8, wherein said outer layer is opaque to hide said obstruction means from the view of the player.

10. A maze puzzle as set forth in claim 5, wherein said outer layer is formed from a knitted synthetic velour fabric material and said inner layer is formed from a lightweight polyester nonwoven interfacing fabric material.

11. A maze puzzle comprising a maze of passages having flexible walls manipulable by a player to effect movement of a solving piece through said passages, said maze being formed from two sheets of liner material sandwiched between two sheets of cover material, and at least said two sheets of liner material being seamed together to close respective sides of said passages.

12. A maze puzzle as set forth in claim 11, wherein said two sheets of liner material and two sheets of cover material are commonly seamed together to close respective sides of said passages.

13. A maze puzzle as set forth in claim 12, wherein said two sheets of liner material are further secured together independently of said two sheets of cover material to form obstructions preventing passage of the solving piece through said passages at respective selective locations in said maze.

14. A maze puzzle as set forth in claim 13, wherein said cover material is opaque to hide said obstructions from the view of the player.

15. A maze puzzle as set forth in claim 14, wherein said sheets normally lie flat one atop the other.

16. A maze puzzle as set forth in claim 1, wherein said maze is formed of material that is substantially not self-supporting.

17. A maze puzzle as set forth in claim 1, further comprising the solving piece, said solving piece being a ball.

18. A maze puzzle comprising a maze of passages for a solving piece, said maze being substantially formed of material that is substantially not self-supporting, such material forming walls of said passages which are pliable by a player to effect movement of the solving piece through said passages, and a plurality of obstructions in said passages for preventing passage of the solving piece through said passages at respective locations in said maze, said obstructions and walls being so formed that the locations of said obstructions cannot be directly identified by exterior viewing or feeling of said walls.

19. A maze puzzle as set forth in claim 1, wherein said maze of passages includes a plurality of concentric passages and a plurality of generally radially extending passages interconnecting said concentric passages.

20. A maze puzzle comprising a solving piece and a maze of passages for said solving piece, at least some of said passages being interconnected to form a solution path for said maze and others of said passages forming dead-end paths connected to said solution path at respective different locations, said solution path having opposite ends terminating at respective openings in said maze permitting passage of said solving piece into and out of said maze, and said maze of passages having flexible wall means manipulable by a player to effect movement of said solving piece through said passages and collapsible at least partly around said solving piece to hold said solving piece essentially stationary when said walls are not being manipulated to effect movement of said solving piece.

* * * * *